United States Patent [19]

Althaus

[11] Patent Number: 4,612,705

[45] Date of Patent: Sep. 23, 1986

[54] OPEN RAZOR

[75] Inventor: Wolfgang Althaus, Wuppertal, Fed. Rep. of Germany

[73] Assignee: Wilkinson Sword Limited, High Wycombe, England

[21] Appl. No.: 636,519

[22] Filed: Aug. 1, 1984

[30] Foreign Application Priority Data

Aug. 24, 1983 [DE] Fed. Rep. of Germany ..... 3330477
Dec. 2, 1983 [GB] United Kingdom ..... 8332282

[51] Int. Cl.[4] ..... B26B 21/10
[52] U.S. Cl. ..... 30/53; 30/40
[58] Field of Search ..... 30/40, 40.2, 53, 55, 30/296 A

[56] References Cited

U.S. PATENT DOCUMENTS 2,192,362 3/1940 Merlo ..... 30/53 X
3,165,831 1/1965 Carroll ..... 30/53 X
3,728,788 4/1973 Pearson ..... 30/53
3,983,627 10/1976 Montrasi ..... 30/53
3,986,260 10/1976 Whiteford ..... 30/296 A
4,441,252 4/1984 Caves ..... 30/53

FOREIGN PATENT DOCUMENTS 218860 7/1924 United Kingdom .
250101 4/1926 United Kingdom .

*Primary Examiner*—Jimmy C. Peters
*Attorney, Agent, or Firm*—John K. Williamson

[57] ABSTRACT

An open razor comprises a blade holder 2 pivoted to a protective cover 3 into and out of which it can be folded. The blade holder 2 supports a blade unit 8 formed by a blade 9 sandwiched between two side members 8',8" of plastics material. Guide grooves 15',15" in the side members are engaged by the inwardly-directed flanges 16',16" of a clamping rail 7 forming part of the blade holder.

The blade units are stored in a dispenser from which they can be withdrawn by sliding the rail 7 fully on to a blade unit and then lifting one end of the rail to lift the blade unit against the force of resilient retaining projections which engage opposite ends of each blade unit to hold it in the dispenser.

4 Claims, 11 Drawing Figures

OPEN RAZOR

BACKGROUND OF THE INVENTION

This invention relates to an open razor (sometimes referred to as a barber's razor or a folding razor) comprising a blade holder carrying a razor blade and a protective cover, the cover and blade holder being pivotally interconnected about a common pivot axis to enable the holder and cover to be folded closed or folded open. The blade holder is provided with a supporting rail having therein a blade support containing a razor blade whose cutting edge projects from the blade support.

Proposals have been made to provide an open razor with a blade which can be replaced at will, but the means which permit the blade to be replaced are not without some element of risk. Proposals have also been made to reduce the risk of using an open razor but many prior art guard arrangements are clumsy and are likely to reduce the effectiveness of shaving with the razor.

BRIEF SUMMARY OF THE INVENTION

According to the present invention there is provided an open razor comprising a blade holder and a protective cover which are pivotally interconnected to permit the holder and cover to be folded between an open position and a closed position about a common pivot axis, the blade holder having a supporting rail to which a replaceable blade unit can be fitted and from which said unit can be removed, said blade unit having a razor blade permanently secured therein.

The present invention also provides an open razor comprising a blade holder pivotally connected to a protective cover about a common pivot axis to permit the holder and cover to be unfolded open or folded closed, the blade holder including a rail for supporting a blade unit formed by a parallel sided strip metal blade which is permanently secured between two elongate side members to form a blade unit, the blade having a cutting edge which extends substantially parallel to the adjacent faces of the side members, the plane containing the blade edge and extending tangentially to an adjacent said side member lying at an angle of between 20° and 25° to the plane of the blade.

BRIEF DESCRIPTION OF THE DRAWINGS

The invention will now be particularly described, by way of example, with reference to the accompanying drawings in which.

DETAILED DESCRIPTION

Figure 1:
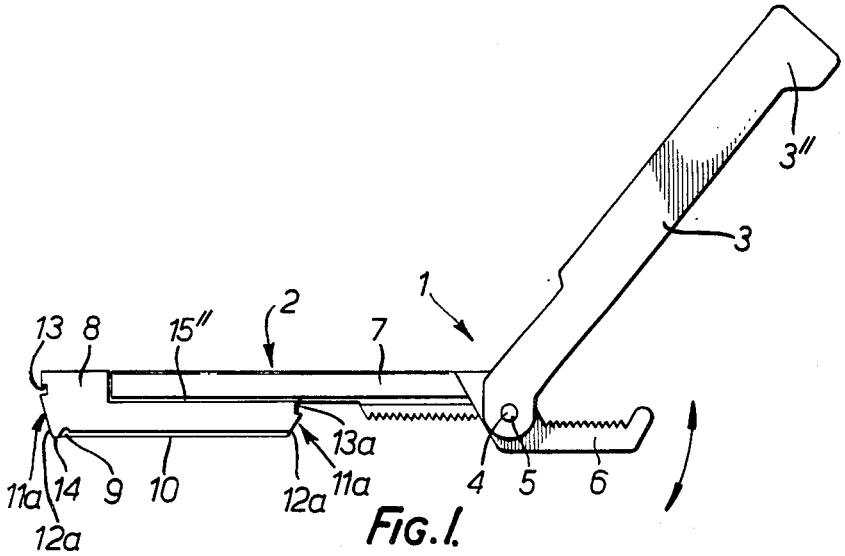
FIG. 1 is a side elevation of an open razor according to the invention shown in its folded open state, and comprising a blade unit, a blade holder and a protective cover.
Figure 2:
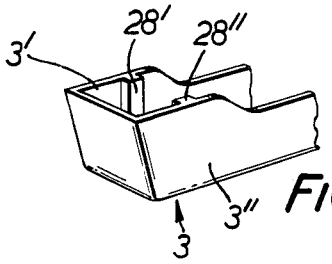
FIG. 2 is a perspective view of the rear portion of the protective cover of the open razor which fits over the blade unit in the closed position of the razor.

The open razor illustrated in FIG. 1 comprises a blade holder 2 and a protective cover 3 which are pivotable about a common pivot axis 4 defined by a rivet 5. The blade holder 2 extends on one side of the axis 4 fo form a finger grip element 6, and on the opposite side of axis 4 in the form of a clamping rail 7. A blade unit 8 containing a razor blade 9 with a cutting edge 10 projecting therefrom, is secured in the clamping rail. As shown by the arrow in FIG. 1, the blade holder 2 can be unfolded open and folded closed, so that the blade unit 8, and in particular the cutting edge 10 of the blade 9. lies within the protective cover 3 in the closed position. As seen from FIG. 2, slide rails 28',28" are formed on the inside of walls 3',3" of the protective cover 3. These rails slide on the blade unit 8 as it moves into the folded position of the razor 1, and a force is transmitted to the blade unit 1 by elastic deformation of the walls 3',3". The action lies between that of a catch and that of a friction lock, and provides a safety device, since it prevents spontaneous opening of the razor 1 whilst it is in the safe, closed position.

Figure 3:
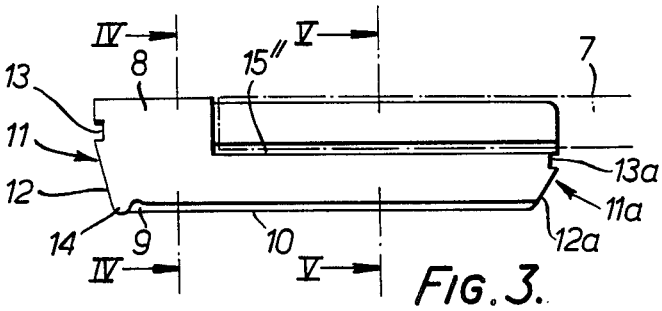
FIG. 3 is a side elevation of the blade unit on a somewhat enlarged scale, with a clamping rail of the open razor being shown by broken lines.
Figure 4:
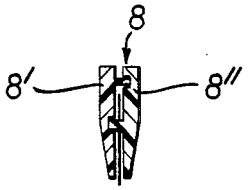
FIG. 4 is a cross-section on the line IV—IV of FIG. 3.
Figure 5:
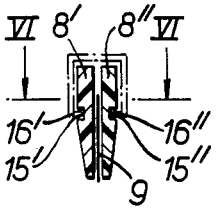
FIG. 5 is a cross-section on the line V—V of FIG. 3.
Figure 6:
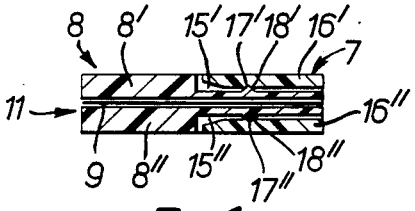
FIG. 6 is a cross-section on the line VI—VI of FIG. 5.

The blade unit 8, with the razor blade 9 therein, is illustrated on a somewhat enlarged scale in FIG. 3, the clamping rail 7 being shown by broken lines. As can be seen particularly in FIGS. 4, 5 and 6, the blade unit 8 comprises two moulded side members 8',8" which form a blade support and between which the blade 9 is permanently sandwiched. The two moulded members 8',8", which are conveniently made of plastics material, are joined together firmly and permanently by means of pins which engage in corresponding recesses along the length of the members.

The two end walls **11,11*a* of the blade unit 8 have impingement surfaces 12,12*a* as well as rectangular recesses 13,13*a*. The front end wall 11 of the blade unit 8 is provided with an edge guard 14 to prevent unintentional cutting by the end of blade 9**.

Parallel to the cutting edge 10 of the razor blade 9, both of the moulded side members 8',8" are provided on their outer sides with guide grooves 15',15", which extend along approximately three-quarters of the total length of the blade unit 8. The clamping rail 7 can be pushed on to the blade unit 8 from the right in FIG. 3, this rail having a cross-section in the form of a downwardly open quadrilateral and incorporating inwardly directed clamping flanges 16',16" which frictionally engage the guide grooves 15',15". The guide grooves 15',15" are provided with locking elements 17',17" which engage in corresponding recesses 18',18" in the clamping flanges 16',16" of the clamping rail 7. To simplify engagement of the clamping rail 7 with the blade unit 8, the clamping flanges 16',16" are slightly chamfered at their forward ends.

Figure 7:
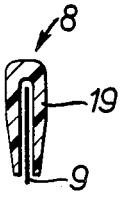
FIG. 7 is a cross-section through a modified blade unit constructed as a one-piece plastics material element with the razor blade embedded therein.

The modification in which the blade unit 8 is constructed as an integrally formed rigid plastics member 19 in which the blade 9 is permanently embedded, is illustrated in FIG. 7.

The blade 9 and the side members 8',8" permanently secured thereto form the blade unit 8 which can be handled safely and without difficulty. Upon substituting a fresh razor blade 9, the latter need no longer be grasped by the user's fingers, so that the risk of cutting himself is reduced to a minimum. The razor blade is rigidly supported by the blade unit 8 so that bending of the blade 9 during shaving is prevented. Accordingly, the blade unit 8 can be of such slender form as to ensure access to all the areas to be shaved.

The blade projects beyond the adjacent edges of the side members to a distance of approximately one millimeter, so that, even if the razor were mishandled, the maximum depth to which the blade could cut is limited to this distance.

The relationship between the blade edge and the adjacent edges of the side members is significant. The imaginary plane which contains the blade edge and which is tangential to the adjacent side member is disposed at an angle of approximately 20° to 25° to the plane of the blade. This means that if the razor is brought into contact with the face of a person being shaved so that both the blade edge and one side member 8' or 8" lie in contact with the face, the shaving angle will be the above-mentioned angle of 20° to 25° which is a suitable shaving angle. The edge of the side member which contacts the shaver's face thus provides a pivot about which the razor can be tilted to bring the blade edge into and out of contact with the face in a controlled manner. Moreover, when the blade edge contacts the face it is automatically located at a suitable shaving angle. The side member thus provides a guide for locating the blade at a correct shaving angle.

Figure 8:
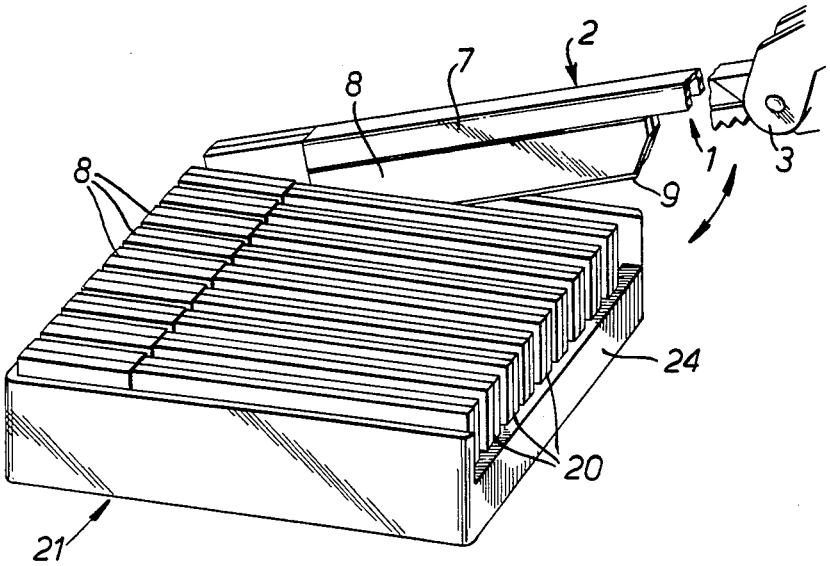
FIG. 8 is a perspective view of a blade dispenser with several blade units arranged therein, the clamping rail of an open razor having been pushed on to one of the blade units and the blade unit partially raised for withdrawal.
Figure 9:
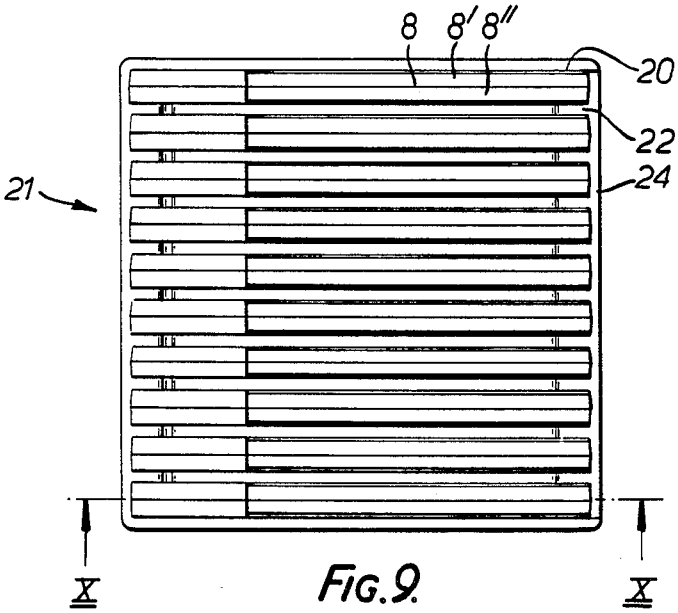
FIG. 9 is a plan view of the blade dispenser of FIG. 8.
Figure 10:
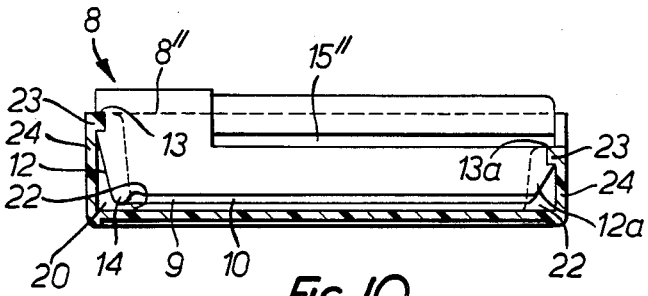
FIG. 10 is a cross-section on the line X—X of FIG. 9.

FIG. 8 illustrates the way in which several blade units 8 can be arranged parallel to one another in compartments 20 of a blade dispenser 21 made of plastics material. The separate compartments 20 are formed by inwardy directed webs 22 of the blade dispenser 21, the separate blade unit 8 being retained therein by resilient projections 23. These projections 23 form part of the casing wall 24 of the blade dispenser 21 and engage in matching recesses 13,13*a* in the blade unit 8, as is seen particularly in FIG. 10.

FIG. 8 illustrates how the individual blade units 8 can be withdrawn from the blade dispenser 21 and reinserted.

In order to withdraw a blade unit 8 (the rearmost blade unit is shown being extracted in FIG. 8), the clamping rail 7 of the open razor 1 is pushed over the blade unit 8 from the right in the drawings, as also illustrated in FIG. 3. After pushing the clamping rail 7 fully on to the blade unit, the blade holder 2 is swung upwardly together with the blade unit 8. During this operation the catch formed by projection 23 is disengaged from the recess 13*a* of the blade unit 8 and the projection 23 in the recess 13 acts as a pivot. The reinsertion of the blade unit 8 occurs in reverse order.

One-handed operation is rendered possible with a blade dispenser 21 of this nature, since the user need no longer take hold of the blade unit 8 when replacing the razor blade. He may hold the open razor 1 with one hand, and the blade dispenser 21 with the other hand. Razor blades can be replaced quite safely in this manner. The blade units 8 are stowed quite safely within the blade dispenser 21 with the cutting edge 10 directed downwards, so that this also ensures safe storage of used blade units 8.

The dispenser is rendered particularly safe if the resistance to withdrawal of a blade unit provided by the resilient projections is so high that withdrawal is practically impossible by hand without the use of the blade holder, or other lever.

Figure 11:
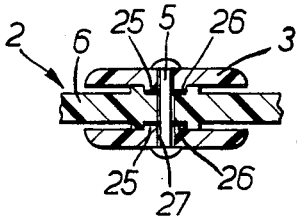
FIG. 11 is a cross-section through the pivot joint of the open razor.

FIG. 11 illustrates a cross-section through the pivot joint between the protective cover 3 and the blade-holder 2. The protective cover 3 is provided on its inner sides with pegs 25 of large diameter which engage in matching recesses 26 in the central part 6, the pegs 25 as well as the recesses 26 being cylindrically formed. Both have a common aperture 27 which is traversed by the fastening rivet 5. The quality of the pivotal mounting becomes independent of the fastening rivets 5 by virtue of the large-diameter pegs 25 and matching recesses 26. In other words, the frictional force does not diminish even during protracted periods of operation with frequent opening and closing of the razor. Together with the slide guides 28',28" in the protective cover 3, this special pivotal joint between the blade holder 2 and the protective cover 3, ensures reliable operation of the razor 1 throughout its life.

By means of the present invention the blade can be made of very thin blade steel, e.g. 0.1 millimeter thick.

I claim:

1. An open razor comprising a blade holder, a protective cover, and pivot means pivotally interconnecting the blade holder and cover to permit the holder and cover to be folded between an open position and a closed position about a common pivot axis, the blade holder comprising a supporting rail and a replaceable blade unit, the rail and blade unit being shaped relative to one another to permit the unit to be fitted to or removed from the rail, said blade unit having a razor blade permanently secured therein, said blade unit extending beyond the outermost end of said rail when the unit is fitted thereto, wherein the blade unit is provided with longitudinal grooves in its opposite sides which extend parallel to the cutting edge of the blade, and the rail has inwardly directed sides which engage the grooves when the blade unit is pushed longitudinally on to the rail.

2. An open razor according to claim 1 wherein a catch is provided on the blade unit for resilient locking engagement with the rail when the unit is fully inserted in the rail.

3. The combination of an open razor and a blade dispenser wherein: said open razor comprises a blade holder, a protective cover, and a pivot means pivotally interconnecting the blade holder and cover to permit the holder and cover to be folded between an open position and a closed position about a common pivot axis, the blade holder comprising a supporting rail and a replacement blade unit, the rail and blade unit being shaped relative to one another to permit the unit to be pushed slidingly onto or off the rail, said blade unit having a razor blade permanently secured therein, said blade unit extending beyond the outermost end of said rail when the unit is fitted thereto; and said blade dispenser contains a plurality of blade units to each of which the supporting rail can be fully fitted prior to removal of the blade unit from the dispenser, said dispenser having locking means whereby each blade unit is resiliently locked within the dispenser and can be extracted therefrom by first fitting the rail to the unit and thereafter tilting the rail to lift one end, and thereafter the other end, of the blade unit from the dispenser, wherein said locking means comprise resilient catch elements located at opposite ends of each blade unit.

4. The combination according to claim 3 wherein each catch element comprises a projection formed on the dispenser and located to engage a recess on the blade unit.

* * * * *